US005470765A

United States Patent [19]

Stiefvater

[11] Patent Number: 5,470,765

[45] Date of Patent: Nov. 28, 1995

[54] POOL TABLE BALL RETURN COMPARTMENT LIGHT

[76] Inventor: Joseph C. Stiefvater, HC 65, Box 346A, Tornado, W. Va. 25202

[21] Appl. No.: 195,086

[22] Filed: Feb. 14, 1994

[51] Int. Cl.[6] ..... A63B 71/00

[52] U.S. Cl. ..... 473/28

[58] Field of Search ..... 473/17, 28, 18, 473/19, 32, 21, 2; 362/133, 132, 127

[56] References Cited

U.S. PATENT DOCUMENTS

| | | | |
|---|---|---|---|
| 1,163,412 | 12/1915 | Jorstad | 473/28 |
| 1,906,131 | 4/1933 | Baylis | 362/127 |
| 2,281,608 | 5/1942 | Vincent | 362/127 |
| 2,448,080 | 8/1948 | Cobbs | 362/127 |
| 3,424,456 | 1/1969 | Daddis | 473/25 |
| 3,474,804 | 6/1969 | Cornell | 473/25 |
| 3,889,945 | 6/1975 | Ellis | 473/28 |
| 4,071,747 | 1/1978 | Pantanella | 362/127 |
| 4,454,569 | 1/1984 | Maguire | 362/127 |
| 4,948,128 | 8/1990 | Emery | 473/17 |
| 5,079,680 | 1/1992 | Kohn | 362/127 |

FOREIGN PATENT DOCUMENTS

| | | | |
|---|---|---|---|
| 577282 | 6/1924 | France | 362/132 |
| 0731004 | 8/1932 | France | 473/2 |
| 0025032 | 11/1969 | United Kingdom | 473/28 |
| 2232606 | 12/1991 | United Kingdom | 473/2 |

*Primary Examiner*—Theatrice Brown
*Attorney, Agent, or Firm*—David L. Baker; Henry S. Miller; Rhodes & Ascolillo

[57] ABSTRACT

A pool table having a gravity fed ball return system with a ball return compartment positioned beneath the playing surface thereof is combined with a self-powered electrical light. Broadly, the light includes a light bulb disposed within the ball return compartment and an electrical circuit for selectively energizing the bulb. The bulb is powered by at least one dry cell battery supported by the pool table. Embodiments of the inventive light having bulbs of both incandescent and fluorescent types are illustrated. One embodiment includes an incandescent bulb which may be selectively energized by axial movement of a metallic rod within a housing secured to the pool table. The second embodiment of the light, including the fluorescent bulb, is provided with an electrical, pushbutton switch mounted upon the side of the pool table for selectively energizing the bulb.

9 Claims, 2 Drawing Sheets

POOL TABLE BALL RETURN COMPARTMENT LIGHT

BACKGROUND OF THE INVENTION

1. Field of the Invention

The present invention relates generally to illumination devices and, more particularly, pertains to a self-powered light adapted for positioning within the ball return compartment of a pool table.

2. Description of the Related Art

The origin of billiards remains obscure. Nevertheless, the available evidence suggests that its birth was in England several hundred years ago. Billiards migrated to the Americas with the Spanish who are known to have played the game in St. Augustine, Fl. in 1565. More recently, pool tables with six pockets have been developed, and the game of pool has become a favorite pastime of thousands throughout the United States.

Generally, pool is a game played by two or more persons, the object of the players being to pocket balls of ivory or other hard material by means of cues. Modern pool tables are rectangular in shape, their top surfaces enclosed by a resilient edge or cushion. Each of the table's four corners are provided with a pocket for the receipt of pool balls. A similar pocket is provided in the center of each of the opposing long edges or cushions of the table. For the sake of convenience, most pool tables are provided with a ball return system wherein pocketed balls are fed along fixed guide paths by gravity into a single compartment beneath the table surface for collection and subsequent reuse. As poor lighting conditions often make it difficult to examine the contents of the compartment without removal of the balls, a need exists for a pool table having a lighted ball return compartment.

U.S. Pat. No. 1,163,412 issued to H. Jorstad on Dec. 7, 1915 provides a light for a pool table netted pocket which is activated by the presence of a ball inside the netted pocket. However, the balls do not travel along fixed guide paths by gravity into a single compartment. Moreover, the light of the Jorstad invention merely indicates the presence of balls in a respective pocket, and does not serve to illuminate the ball compartment for further ball identification.

U.S. Pat. No. 3,889,945 issued to Ellis on Jun. 17, 1975 provides a lighting fixture mounted beneath the pool table playing surface for purposes of lighting the playing surface without the use of overhead lamps. However, Ellis does not teach using the light to illuminate a single ball compartment; instead, Ellis advocates the elimination of tunnels or runways underneath the table leading from the pockets to a collecting box at one end of the table.

SUMMARY OF THE INVENTION

In a preferred embodiment, the present invention, in combination with a pool table having a gravity fed ball return system and a ball return compartment beneath the playing surface of the table, a self-powered electrical light, comprises an electrical light bulb, disposed within the ball return compartment, and an electrical circuit for selectively energizing the bulb and causing such to emit visible light, thereby illuminating the ball return compartment.

The electrical circuit includes: at least one battery for energizing the bulb, the at least one battery having a first electrical pole and a second electrical pole; and a switch for manually opening and closing the electrical circuit. The bulb can be either of the incandescent type or the fluorescent type.

The switch can be of the variety that closes the circuit while pressure is applied to the switch, and opens the circuit when pressure is released.

The preferred embodiment also comprises: a rigid housing adapted for mounting within the ball return compartment of the pool table for retaining the bulb and the at least one battery; an electrically conductive reflector, having a socket for receiving the light bulb, joined to the housing; a bulb connecting contact secured to the reflector for providing an electrical connection between the first electrical pole of the at least one battery and the reflector.

The switch includes: an electrically insulating gasket, having a central bore, disposed adjacent the at least one battery; an electrically conductive rod slidably engaged with the housing and having a first free end disposed within the central bore; an electrically conductive plate secured to the rod and in electrical contact therewith; an electrically conductive strip having one of its ends in contact with the reflector and having its second end disposed adjacent the plate; and a compressed spring positioned between the gasket and the plate for normally biasing the plate away from the conductive strip. The selective longitudinal movement of the rod brings the first free end of the rod into contact with the second electrical pole of the at least one battery and brings the plate into contact with the strip, thereby completing an electrical circuit causing the bulb to glow.

The present invention also comprises, in a preferred embodiment, a housing adapted for mounting within the ball return compartment of the pool table for retaining the bulb and the at least one battery. Additionally, the electrically conductive rod comprises an L-shaped heavy gauge wire having: a horizontal leg for movement within the central bore, and a transverse leg extending normally from the horizontal leg. The first free end of the rod is disposed at a distal end of the horizontal leg and is disposed within the central bore, and a second free end of the rod is disposed at a distal end of the transverse leg, the second free end serving as a handle.

In a second preferred embodiment, the present invention is a pool table light comprising: a rigid housing adapted for mounting with a ball return compartment of a pool table; at least one battery having a first electrical pole disposed at one end thereof and a second electrical pole disposed at the other end thereof, the at least one battery being secured within the housing; an electrically conductive reflector joined to the housing; a light bulb receiving socket, disposed within the reflector; a light bulb, secured within the socket, having a button in electrical contact with the first electrical pole and a threaded base in electrical contact with the reflector; a switch for selectively energizing the light bulb which includes an electrically insulating gasket, having a central bore, disposed adjacent the at least one battery, an electrically conductive rod slidably engaged with the housing and having a free end disposed within the central bore, an electrically conductive plate secured to the rod and in electrical contact therewith, an electrically conductive strip having one of its ends in contact with the reflector and having its second end disposed adjacent the plate, and a compressed spring positioned between the gasket and the plate for normally biasing the plate away from the conductive strip. The selective longitudinal movement of the rod brings the free end of the rod into contact with the second electrical pole of the at least one battery and brings the plate into contact with the strip thereby completing an electrical circuit causing the bulb to glow.

The housing in the second preferred embodiment is substantially cylindrical in configuration and includes a circular cap at one of its ends, wherein the cap includes a central orifice for slidable engagement with the rod. Also, the electrically conductive rod comprises an L-shaped heavy gauge wire having a horizontal leg for movement within the central bore and within the central orifice, and a transverse leg extending normally from the horizontal leg. The first free end of the rod is disposed at a distal end of the horizontal leg and is disposed within the central bore, and a second free end of the rod is disposed at a distal end of the transverse leg, the second free end serving as a handle. The bulb is of incandescent type.

In an alternate embodiment, the present invention comprises: a housing adapted for mounting within the ball return compartment of a pool table; a fluorescent bulb secured to the housing; a plurality of batteries secured to the housing, the batteries being connected in an electrical series to the fluorescent bulb; and a switch adapted for mounting upon the side of a pool table in electrical communication with the batteries for selectively energizing the bulb. The switch can be of the variety that closes the circuit while pressure is applied to the switch, and opens the circuit when pressure is released.

It is a principal object of the present invention to provide, in combination with a pool table having a gravity fed ball return system with a ball return compartment positioned beneath the playing surface thereof, a self-powered electrical light including a light bulb disposed within the ball return compartment and an electrical circuit for selectively energizing the light bulb and causing such to emit visible light.

A further object of the present invention is to provide a lighted pool table of the type described with a bulb of fluorescent or incandescent type.

It is an object of the invention to provide improved elements and arrangements thereof in a pool table light which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
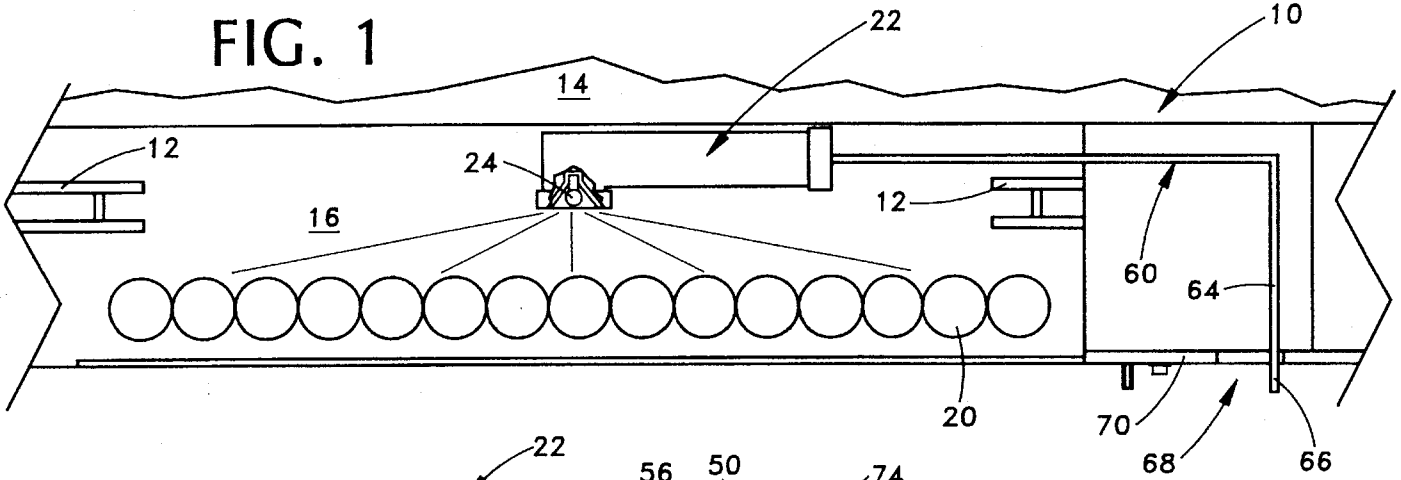
FIG. 1 is a top view of a pool table light in accordance with the present invention positioned within the ball return compartment of a pool table. The resilient side cushions of the pool table have been removed to reveal details of the ball return compartment.

Referring now to FIG. 1, a pool table 10 having a gravity fed ball return system, indicated generally 12, is illustrated. Positioned beneath the playing surface 14 of the table 10, the floor 16 of the ball return compartment 18 is the lowest elevational point of the system 12, and pool balls 20 accumulate there prior to reuse in subsequent games. Secured to the pool table 10, and positioned adjacent the top of the ball return compartment 18, is a self-powered electrical light 22 including an electrical light bulb 24 and an electrical circuit for selectively energizing the bulb 24 and causing such to light the compartment 18. Held beneath the bulb 24, the pool balls 20 may be easily viewed when the bulb is energized.

Figure 2:
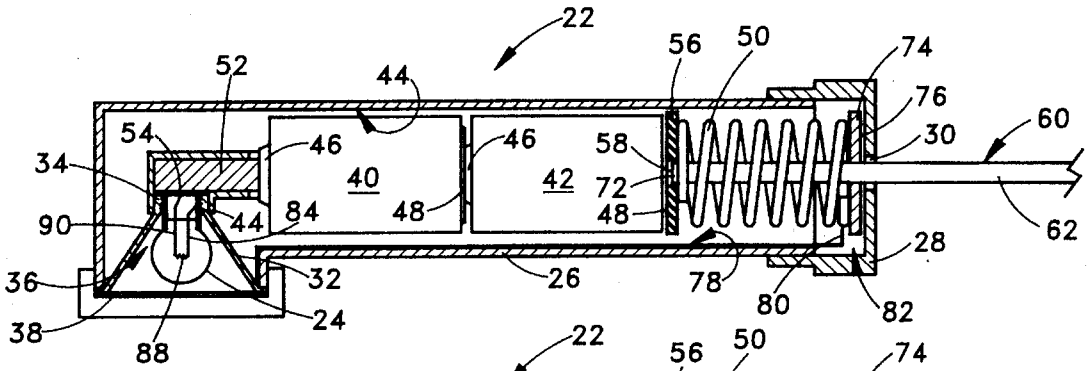
FIG. 2 is a cross-sectional view of the pool table light of FIG. 1 showing the electrical switch in its open or "off" position.
Figure 3:
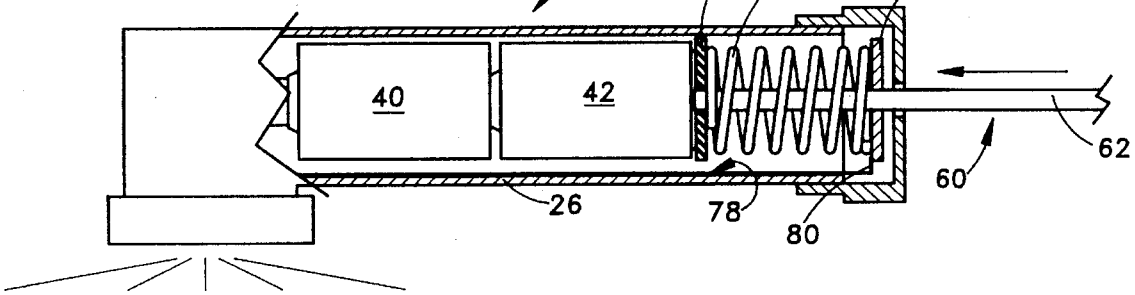
FIG. 3 is a cross-sectional view of the pool table light of FIG. 1 showing the electrical switch in its closed or "on" position.

As may be seen most clearly in FIGS. 2 and 3, the pool table light 22 includes a housing 26 of substantially cylindrical shape, formed from a rigid, thermoplastic material or metal. One end of the housing 26 is closed by a circular cap 28 and preferably held in place by friction. Of course, the cap 28 may be threadably secured or permanently retained in place by well-known adhesive cements. The cap 28 has a central opening or orifice 30 providing limited access to the interior of the housing 26 in a manner which will be hereinafter described.

Joined to the housing 26, opposite cap 28, is a conically-shaped reflector 32 formed from an electrically conductive material. At its narrowed, upper end, the reflector 32 is provided with an integral, cylindrical extension 34 defining a socket 36 for receiving the incandescent light bulb 24. The bulb 24 is screwed into the socket 36 in the center of the reflector 32. At the front of the reflector 32 is a flat piece of transparent glass or plastic 38 to protect the bulb 24. A glass lens (not shown) for either spreading or concentrating the light of the bulb 24 may be substituted for the flat piece of transparent material 38.

Two dry cell batteries 40 and 42 are secured in series within the housing 26 between the cap 28 and reflector 32. The batteries provide an electrical current for energizing the incandescent bulb 24. Each of the batteries 40 and 42 is substantially cylindrical in configuration and is snugly held by the inner wall 44 of the housing 26. Each of the batteries 40 and 42 further include electrical poles or electrodes at each of their respective ends, i.e. a positive electrode or anode 46 (into which electrical current flows) is positioned at each forward end and a negative electrode or cathode 48 (out of which electrical current flows) is disposed at each rearward end.

At the rear of the housing 26, adjacent cap 28, is a coiled and compressed spring 50. The spring 50 biases the rearward battery 42 against the forward battery 40. The anode 46 of the rearward battery 42 is held tightly in contact with the cathode 48 of the forward battery 40. Further, the anode 46 of the forward battery 40 is held tightly against a contact 52 in electrical communication with the button 54 on the top of the bulb 24. It should be noted that the compressive force exerted by the spring 50 is insufficient to dislodge the cap 28 from the remainder of the housing 26 when the cap is secured by friction alone.

A circular gasket 56, having a central bore 58, is disposed between the spring 50 and the rearward battery 42. As the gasket 56 is fabricated from a material which is an electrical insulator, the spring 50 is essentially isolated from contact with the cathode 48 of battery 42.

An electrically conductive rod 60 is in slidable engagement with the central orifice 30 of the cap 28. The rod 60 comprises a length of heavy gauge wire bent into an L-shaped form so as to include a horizontal leg 62, for movement within the orifice 30, and a transverse leg 64 extending normally therefrom. The free end 66 of the transverse leg 64 extends through a slot 68 in the side wall 70 of the pool table 10 and serves as a handle for manipulation by the human hand. The free end 72 of the horizontal leg 62, on the other hand, is fitted within the central bore 58 of the gasket 56. An electrically conductive plate 74 is secured to the rod 60 and is in electrical contact therewith. The plate 74 is circular in shape and its center corresponds with that of the longitudinal axis of the horizontal leg 62. The distance between the rearward side 76 of the plate 74 and the free end 72 of the horizontal leg 62 is only slightly less than the distance between the cathode 48 of the rearward battery 42 and the cap 28. As the difference between these two distances is less than the thickness of the insulating gasket 56, the free end 72 of the horizontal leg 62 is confined to the central bore 58 of the gasket 56 throughout its entire range of motion.

Attached to the inside of the housing 26, and running along its length, is a strip of metal 78 that makes contact with the reflector 32 at its forward end. At the rear of the housing 26, the metal strip 78 terminates at an electrical contact 80 separated from the plate 74 by a narrow gap or space 82. The gap 82 is normally retained in an open position by the spring 50 which biases the plate 74 against the rear wall of the housing 26, i.e., the cap 28.

Selective longitudinal movement of the rod 60 to the left, as indicated by the arrow in FIG. 3, brings the free end 72 of the horizontal leg 62 into contact with the cathode 48 of the rearward battery 42 and simultaneously brings the plate 74 into contact with the metal strip 78 at contact 80 completing an electrical circuit causing the bulb 24 to glow. Movement of the rod 60 may be accomplished by the application of a force to the handle end 66 of the transverse leg 64 sufficient to overcome the compressive strength of the spring 50.

When the electrical circuit is completed by moving the rod 60, current flows from the cathode 48 of the rearward battery 42 to the rod 60 at the rear of the housing 26. From the rod 60, electrical current flows forward through the plate 74 to the metal strip 78 and continues along the strip to the bottom of the reflector 32. The reflector 32, preferably made of polished metal, provides a path for the current to follow to the cylindrical extension 34 in the reflector. Electrical current which enters the threaded base 84 of the bulb 24 flows up a thin wire 86 inside the bulb to one end of the coiled filament 88. Current flowing through the filament 88 causes such to glow brightly, and the bulb 24 is lit. Electrical current leaving the filament 88 travels down a second wire 90 to the contact button 54 at the top of the bulb, and from there to the anode 46 of the forward battery 40 through contact 52. Then, as is well known, the electrical current moves through the chemicals in the battery 40 to its cathode 48. The current continues out of the forward battery 40 and into the anode 46 of the rearward battery 42, flowing through the chemicals to its cathode 48 where the current began its round trip. The circuit is complete.

Figure 4:
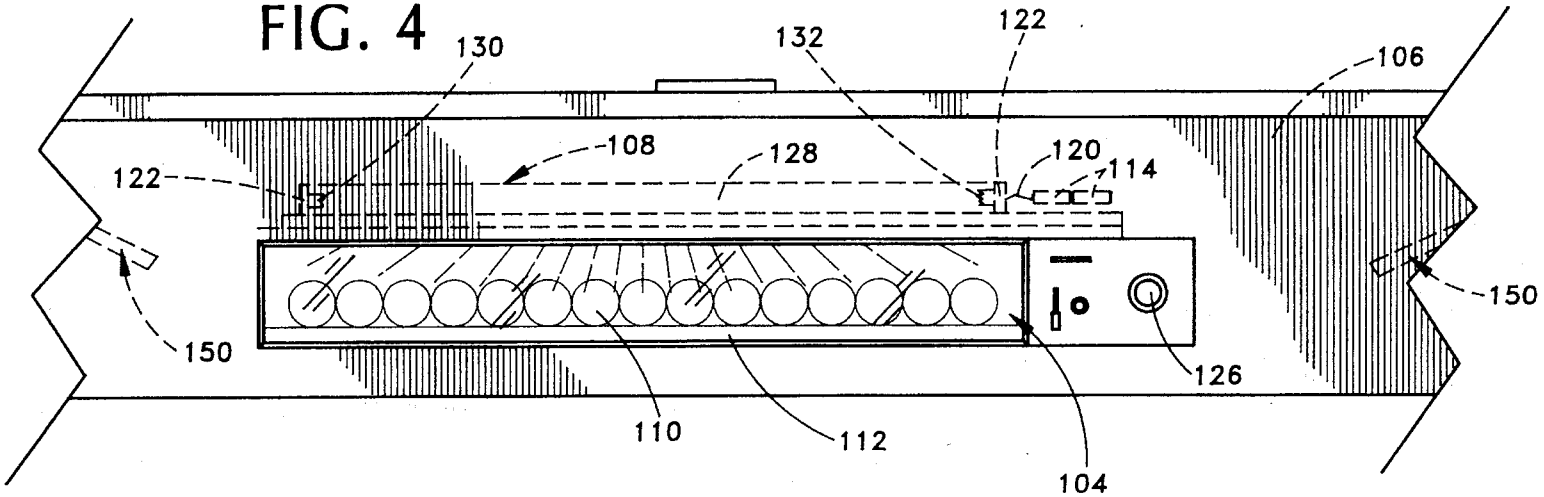
FIG. 4 is a side elevational view of a second embodiment of a pool table light positioned within the ball return compartment of a pool table.
Figure 5:
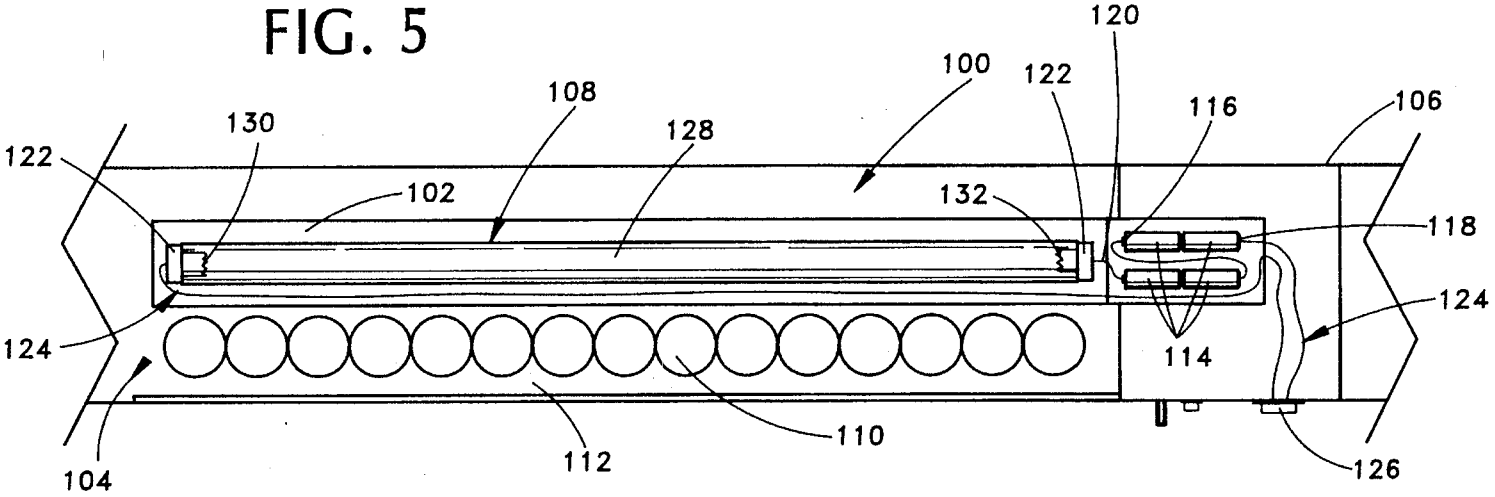
FIG. 5 is a top plan view of the pool table light of FIG. 4 positioned within the ball return compartment of a pool table. The resilient side cushions of the pool table have been removed to reveal details of the ball return compartment.

A second embodiment of a pool table light, including a fluorescent bulb, is illustrated in FIGS. 4 and 5. This particular light 100 includes a housing 102 horizontally mounted within the ball return compartment 104 of a pool table 106. A fluorescent bulb 108, secured to the housing 102, is connected to an electrical circuit for selectively causing the bulb to light the compartment 104. Positioned beneath the bulb 108 are a number of pool balls 110, supported by the floor 112 of the compartment 104, which may be easily viewed when the bulb 108 is energized. The guide rails which deliver the pool balls to the compartment 104 are illustrated generally at 150.

The electrical circuit includes four, dry cell batteries 114 secured to the housing 102 in an electrical series. Each of the batteries 114 is substantially cylindrical in configuration and is snugly held against the housing 102 by a spring clip (not shown) or other similar means. The batteries 114 include electrodes at each of their respective ends. A positive electrode or anode 116 is positioned at each forward end and a negative electrode or cathode 118 is disposed at each rearward end.

The batteries 114 are connected in an electrical circuit with the fluorescent bulb 108. A wire 120 connects the positive electrode or anode 116 of the batteries 114 to a electrical contact 122 at one end of the fluorescent bulb 108. A second wire 124 connects the negative electrode or cathode 118 of the batteries 114 to a similar electrical contact at the opposite end of the bulb 108. Disposed between the ends of the second wire 124 is a separation or gap (not shown) that is part of a switch 126. Preferably, the switch 126 has a single push-button for closing the gap in the wire 124 and energizing the bulb 108 while depressed. When the pushbutton is released, the gap will be opened again and the bulb 108 will be switched off. For the sake of convenience, the switch 126 is mounted upon the side of the pool table 106 in close proximity to the ball return compartment 104. Nevertheless, the switch 126 could be positioned at any other desired location.

The fluorescent bulb 108 consists of a long sealed glass tube 128 with a filament, 130 and 132 respectively, at each of its ends. Within the tube are argon gas and a trace amount of mercury. Baked upon the inside of the tube 128 is a coating made from a mixture of powdered fluorescent substances commonly referred to as phosphors. These substances emit light when struck by electromagnetic radiation.

When the switch 126 is closed, electrical current enters the tube 128 and passes through the cathodic filament 130, heating it to incandescence. This causes the filament 130 to emit electrons at high speed. The positively-charged anodic filament 132 at the opposite end of the tube attracts the negatively charged electrons. A collision of an electron with a mercury atom releases ultraviolet radiation which is absorbed by the phosphors on the tube walls. The phosphors, in turn, emit their own radiation in the form of visible light. The color of the light emitted by the bulb 108 may be varied by using different phosphor compounds.

It is to be understood that the present invention may be embodied in other specific forms and is not limited to the two embodiments described above, but encompasses any and all embodiments within the spirit and scope of the following claims. Therefore, the present embodiment must be considered in all respects as illustrative only.

I claim:

1. In combination with a pool table having a gravity fed ball return system and a ball return compartment beneath the playing surface of the table, an electrical light to illuminate the ball compartment, comprising:

an electrical circuit comprising:

at least one battery for energizing said bulb, said at least one battery having a first electrical pole and a second electrical pole; and a switch for manually opening and closing said electrical circuit;

an electrical light bulb, in the electrical circuit; and the electrical light bulb disposed within said ball return compartment;

a rigid housing mounted in the ball return compartment of the pool table;

said bulb and said at least one battery retained in the rigid housing;

an electrically conductive reflector, having a socket for receiving said light bulb, joined to said housing;

a bulb connecting contact secured to said reflector for providing an electrical connection between the first electrical pole of said at least one battery and said reflector; and said switch includes:

an electrically insulating gasket, having a central bore, disposed adjacent said at least one battery;

an electrically conductive rod slidably engaged with said housing and having a first free end disposed within said central bore;

an electrically conductive plate secured to said rod and in electrical contact therewith;

an electrically conductive strip having one of its ends in contact with said reflector and having its second end disposed adjacent said plate; and a compressed spring positioned between said gasket and said plate for normally biasing said plate away from said conductive strip;

whereby selective longitudinal movement of said rod brings the first free end of said rod into contact with the second electrical pole of said at least one battery and brings said plate into contact with said strip thereby completing an electrical circuit causing said bulb to glow.

2. The combination according to claim 1, wherein said bulb further comprises an incandescent bulb.

3. The combination according to claim 1, wherein said bulb further comprises a fluorescent bulb.

4. The combination according to claim 3, further comprising a housing mounted within said ball return compartment of the pool table for retaining said bulb and said at least one battery.

5. The light as described in claim 1, wherein said electrically conductive rod comprises an L-shaped heavy gauge wire having:

a horizontal leg for movement within said central bore; and a transverse leg extending normally from said horizontal leg;

the first free end of said rod being disposed at a distal end of said horizontal leg and being disposed within said central bore;

a second free end of said rod being disposed at a distal end of said transverse leg;

said second free end serving as a handle.

6. A light, for a pool table, comprising:

a rigid housing for mounted in a ball return compartment of a pool table;

at least one battery having a first electrical pole disposed at one end thereof and a second electrical pole disposed at the other end thereof, said at least one battery being secured within said housing;

an electrically conductive reflector joined to said housing;

a light bulb receiving socket, disposed within said reflector;

a light bulb, secured within said socket, having:

a button in electrical contact with said first electrical pole; and a threaded base in electrical contact with said reflector;

a switch for selectively energizing said light bulb including:

an electrically insulating gasket, having a central bore, disposed adjacent said at least one battery;

an electrically conductive rod slidably engaged with said housing and having a free end disposed within said central bore;

an electrically conductive plate secured to said rod and in electrical contact therewith;

an electrically conductive strip having one of its ends in contact with said reflector and having its second end disposed adjacent said plate; and a compressed spring positioned between said gasket and said plate for normally biasing said plate away from said conductive strip;

whereby selective longitudinal movement of said rod brings the free end of said rod into contact with said second electrical pole of said at least one battery and brings said plate into contact with said strip thereby completing an electrical circuit causing said bulb to glow.

7. The pool table light according to claim 6, wherein said housing is substantially cylindrical in configuration and includes a circular cap at one of its ends, wherein said cap includes a central orifice for slidable engagement with said rod.

8. The pool table light as described in claim 6, wherein said electrically conductive rod comprises an L-shaped heavy gauge wire having:

a horizontal leg for movement within said central bore and within said central orifice; and a transverse leg extending normally from said horizontal leg; the first free end of said rod being disposed at a distal end of said horizontal leg and being disposed within said central bore, and a second free end of said rod being disposed at a distal end of said transverse leg, said second free end serving as a handle.

9. The pool table light according to claim 6, wherein said bulb is of incandescent type.

* * * * *